United States Patent [19]

Hadley

[11] 4,134,368

[45] Jan. 16, 1979

[54] FUEL INJECTION CONTROL SYSTEM

[75] Inventor: Dawson N. Hadley, Claremont, Calif.

[73] Assignee: Edelbrock-Hadley Corporation, El Segundo, Calif.

[21] Appl. No.: 803,606

[22] Filed: Jun. 6, 1977

[51] Int. Cl.[2] ..... F02B 3/00

[52] U.S. Cl. ..... 123/32 EA

[58] Field of Search ..... 123/32 EA, 32 ED, 32 EF

[56] References Cited

U.S. PATENT DOCUMENTS

| | | | |
|---|---|---|---|
| 3,548,791 | 12/1970 | Long | 123/32 EA |
| 3,699,932 | 10/1972 | Aono et al. | 123/32 EA |
| 3,713,427 | 1/1973 | Adler | 123/32 EA |
| 3,734,068 | 5/1973 | Reddy | 123/32 EA |
| 3,780,711 | 12/1973 | Lindberg | 123/32 EA |
| 3,817,226 | 6/1974 | Wakamaka et al. | 123/32 EA |
| 3,835,819 | 9/1974 | Anderson, Jr. | 123/32 EA |
| 3,854,458 | 12/1974 | Reddy | 123/32 EA |
| 3,882,829 | 5/1975 | Sasaki | 123/32 EA |
| 3,893,432 | 7/1975 | Krupp et al. | 123/32 EA |
| 3,898,962 | 8/1975 | Honig et al. | 123/32 EA |
| 3,906,207 | 9/1975 | Rivere et al. | 123/32 EE |
| 3,935,851 | 2/1976 | Wright et al. | 123/32 EA |
| 3,960,120 | 6/1976 | Aono et al. | 123/32 EA |
| 3,971,348 | 7/1976 | Scofield | 123/32 EA |

*Primary Examiner*—Charles J. Myhre
*Assistant Examiner*—R. A. Nelli
*Attorney, Agent, or Firm*—Christie, Parker & Hale

[57] ABSTRACT

A plurality of sensors generate signals representing engine parameters indicative of the engine fuel requirement. These signals are all applied to a single function generator to form a composite signal that is a nonlinear function of the engine fuel requirement. One of the sensors responds to absolute intake manifold pressure; responsive to this sensor, operation is inhibited, while the absolute intake manifold pressure is below a predetermined value representative of engine deceleration. An engine starter switch generates a trigger pulse to actuate an overriding multivibrator that overrides normal operation as the engine is started. One of the sensors also responds to engine coolant temperature; responsive to this sensor, the actuation duration of the overriding multivibrator is controlled in reverse relation to the coolant temperature. A manual switch, which generates a trigger pulse responsive to closing, is coupled to the overriding multivibrator to with actuate it responsive to each trigger pulse generated by the switch.

19 Claims, 5 Drawing Figures

FUEL INJECTION CONTROL SYSTEM

BACKGROUND OF THE INVENTION

This invention relates to fuel injection in an internal combustion engine and, more particularly, to an improved fuel injection control system.

In one type of fuel injection control system in the prior art, the quantity of fuel injected into the engine's cylinders is controlled by varying the interval during which the fuel injectors are open. Usually, a plurality of sensors generate signals representing engine parameters indicative of the engine fuel requirement, such as absolute intake manifold pressure, engine speed, air temperature, and water temperature. Function generators individual to the sensors linearize the relationship between the sensed parameters and the fuel requirement. The outputs of the function generators are combined to form a composite signal, which is applied to a voltage controlled oscillator. The open interval of each fuel injector is determined by the time required for a counter to which the voltage controlled oscillator is connected counts a predetermined number of oscillator cycles. The higher the frequency of the voltage controlled oscillator, the faster the counter counts the predetermined number of cycles and the shorter is the open interval of the fuel injector. The conversion of the composite fuel requirement signal to a frequency requires a separate counter and corresponding control and logic circuitry for each fuel injector.

SUMMARY OF THE INVENTION

According to one aspect of the invention, a plurality of one-shot multivibrators corresponding to the respective fuel injectors in a fuel injection internal combustion engine each have a quasi-stable state during which injector drivers open the corresponding fuel injectors. Responsive to engine rotation, trigger pulses are generated to initiate the quasi-stable state of each one-shot multivibrator in turn. The duration of the quasi-stable state of the multivibrators is controlled in proportion to a characteristic of a fuel requirement signal generated responsive to one or more sensors of engine parameters indicative of the engine fuel requirement. The one-shot multivibrators effect a direct conversion of the fuel requirement signal to the open interval of the fuel injector, rather than an indirect conversion with frequency as in intermediary.

According to another aspect of the invention, a plurality of sensors each generate a signal with a characteristic representing one engine parameter indicative of the engine fuel requirement. These signals are combined to form a composite signal with a characteristic that is a nonlinear function of the engine fuel requirement. The composite signal is applied to a function generator to generate a fuel requirement signal with a characteristic that is a direct linear function of the engine fuel requirement. Each fuel injector is opened for an interval proportional to the characteristic of the fuel requirement signal. It has been discovered that a single function generator can effectively serve to linearize the relationship between a plurality of engine parameters and the engine fuel requirement by so linearizing the composite signal rather than each individual signal generated by the plurality of sensors.

As a feature of the invention, all the fuel injectors are inhibited responsive to a sensor of absolute intake manifold pressure while the absolute pressure in the intake manifold is below a predetermined value representative of engine deceleration.

As another feature of the invention, the fuel injectors are opened simultaneously during engine startup for one or more intervals inversely related to the engine coolant temperature. Preferable, the fuel injectors are opened once in response to the engine starter switch and/or in response to each actuation of a manually actuatable switch.

As still another feature of the invention, the engine parameters indicative of the engine fuel requirement are linearized by a function generator having a plurality of parallel stages each of which comprises an operational amplifier with a capacitor and resistor in parallel between the output and one of its inputs, and a threshold bias voltage applied to its other input.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
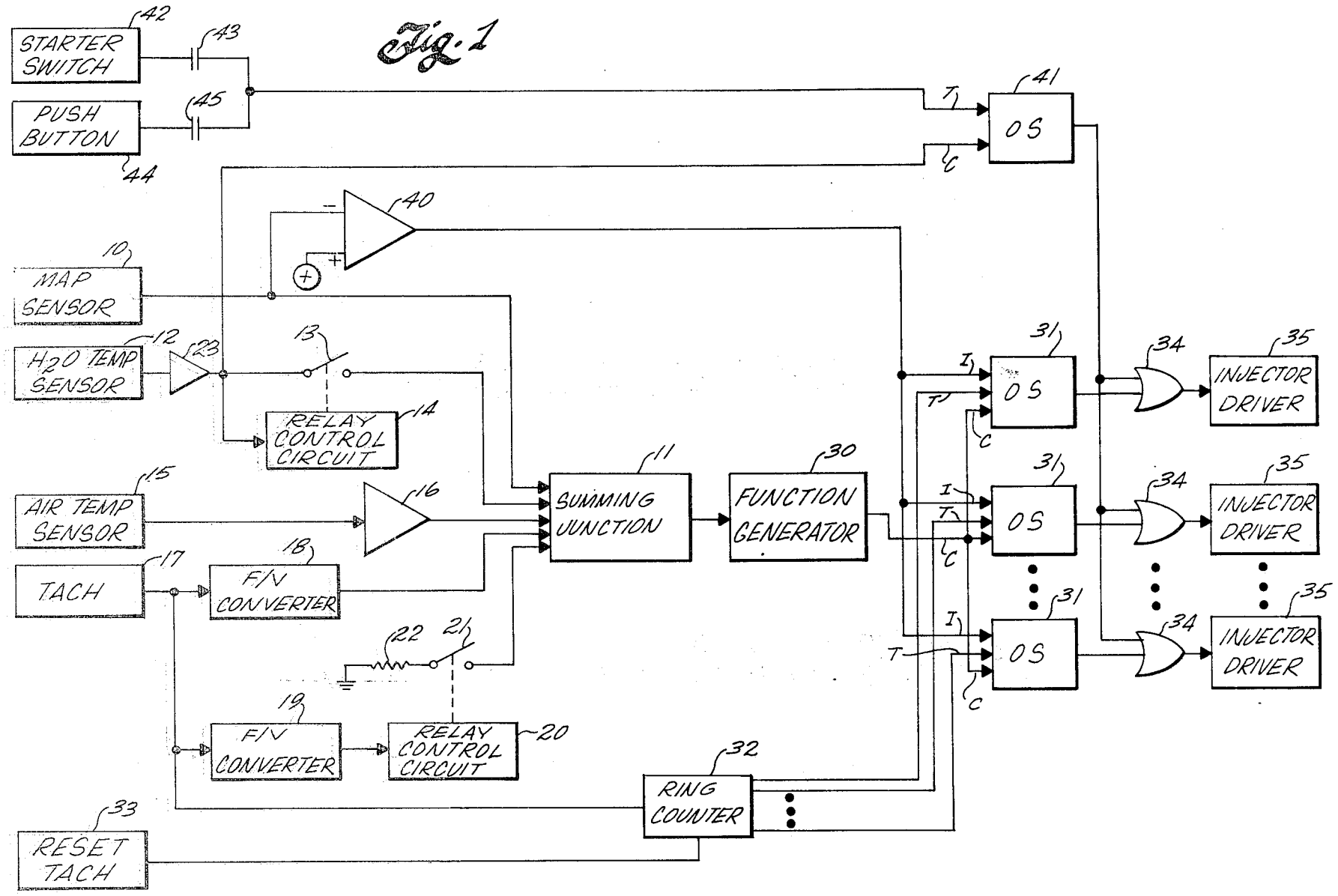
FIG. 1 is a schematic block diagram of a fuel injection control system for an internal combustion engine incorporating the principles of the invention.

In FIG. 1, the output of a manifold absolute pressure (MAP) sensor 10 is directly connected to a summing junction 11. A water temperature ($H_2O$ TEMP) sensor 12 is connected through an inverting amplified 23 and a relay contact pair 13 to summing junction 11. The output of sensor 12 is also connected to a relay control circuit 14, which opens and closes contact pair 13. An air temperature (AIR TEMP) sensor 15 is connected by a saturable inverting amplifier 16 to summing junction 11. A tachometer (TACH) 17 is coupled by a frequency-to-voltage (F/V) converter 18 to summing junction 11. Tachometer 17 is also coupled by a frequency-to-voltage (F/V) converter 19 to a relay control circuit 20, which opens and closes a relay contact pair 21. Relay contact pair 21 and a resistor 22 are connected in series from ground to summing junction 11. Sensors 10, 12, and 15, and tachometer 17 respond to a number of engine parameters indicative of the engine fuel requirement of a fuel injection internal combustion engine. The engine has a plurality of cylinders and an equal number of fuel injectors with a variable open interval that controls the quantity of injected fuel. The fuel injectors are bistable valves that are either open or closed.

In the preferred form of the invention, sensors 10, 12, and 15 are mounted in an inlet manifold specially designed for the described fuel injection control system along with the fuel injectors.

The absolute pressure in the intake manifold, which is representative of the throttle position, i.e., the position of the butterfly valve in the air horn, i.e., the air inlet to the intake manifold, is the principal sensed engine parameter indicative of the engine fuel requirement. Sensor 10, which could be a linear voltage-displacement transducer having a diaphragm that moves responsive to absolute pressure, is located in the intake manifold chamber at a position representative of the average pressure therein. The signal magnitude at the output of sensor 10 is directly proportional to the manifold absolute pressure, which is directly and nonlinearly related to the engine fuel requirement. In other words, the higher the absolute pressure, the higher is the fuel requirement.

The engine coolant temperature, which reflects the engine temperature, is an engine parameter indicative of the engine fuel requirement at low engine temperature. In other words, at low engine temperature more fuel is required than at high engine temperature. Sensor 12, which generates a signal directly proportional to the coolant temperature, i.e., the water temperature, could be located in the water jacket in the intake manifold. Sensor 12 is typically a resistance-temperature device, i.e., a device that changes resistance in direct proportion to its temperature. Amplifier 23 inverts the signal generated by sensor 12. Relay control circuit 14 holds relay contact pair 13 closed until the signal magnitude at the output of amplifier 23 drops below a predetermined value indicating a warm coolant temperature, at which point relay contact pair 13 is opened by relay control circuit 14. Typically, this warm coolant temperature would be in the order of 130° F. Thus, sensor 12 generates a signal which in effect serves as a proportional choke, i.e., a choke inversely proportional to engine temperature, which drops out after the engine becomes warm.

Air temperature in the intake manifold is also an engine parameter indicative of the engine fuel requirement. The higher the air temperature, the lower is the air density and, thus, the required quantity of fuel. Sensor 15 could be mounted on the air horn, i.e., the inlet to the intake manifold to sense the air temperature after passage through the air cleaner. Sensor 15 could also be a resistance-temperature device that produces a signal having a magnitude directly proportional to the temperature of the device. Amplifier 16 inverts the signal generated by sensor 15. When the output signal magnitude of sensor 15 exceeds a value representative of a high air temperature such for example, as 200° F, amplifier 16 saturates to prevent excessive leaning of the air-fuel mixture.

Another engine parameter indicative of the engine fuel requirement is engine speed. The higher the engine speed, the higher is the quantity of fuel required by the engine. Tachometer 17, which is driven by the engine, could be a magnetic type pickup pulse generator that produces eight equally spaced pulses during each complete engine cycle. F/V converter 18. which is a conventional, commercially available circuit component, produces a signal having a magnitude directly proportional to the frequency of the pulses generated by tachometer 17.

In the case of an automatic transmission, the engine fuel requirement drops when the transmission is in gear while the engine is idling. When this occurs, the engine speed drops to its lowest value. As a result, the output of F/V converter 19, which is identical to F/V converter 18, drops below a threshold value, and, responsive thereto, relay control circuit 20 closes relay contact pair 21. Consequently, the signal magnitude at the input of summing junction 11 decreases. For all other conditions, relay contact pair 21 is open.

Summing junction 11 could comprise a conventional resistance summing junction in which the resistors associated with the respective inputs are selected to provide the desired relative weighting among the input signals. Typically, the weighting is such that the air temperature and water temperature have a maximum effect of 5% of the manifold absolute pressure and the engine speed has a maximum effect of 10% of the manifold absolute pressure. Accordingly, at the output of summing junction 11, a composite signal is generated which is directly and nonlinearly related to the engine fuel requirement.

The composite signal is coupled to a function generator 30, which linearizes the relationship. In other words, the output of function generator 30 is a fuel requirement signal, the magnitude of which is a direct linear function of the engine fuel requirement. The details of function generator 30 are discussed below in connection with FIGS. 3, 4, and 5. It has been found that a single function generator such as function generator 30 can effectively serve to linearize the relationship between the output signal magnitudes of all of sensors 10, 12, and 15, and tachometer 17 and the engine fuel requirement.

A plurality of one-shot (OS) multivibrators 31 correspond to the respective fuel injectors, which in the usual 8-cylinder engine are eight in number. Each of one-shot multivibrators 31 has a control input C, a trigger input T, and an inhibit input I, and an output that is normally unenergized. Upon application of a trigger pulse to trigger input T of one of one-shot multivibrators 31, the quasi-stable state of such multivibrator is initiated and its output becomes energized. The duration of the quasi-stable state and the energization of the output varies in direct proportion to the magnitude of the signal applied to control input C of each one-shot multivibrator 31. When the inhibit input I of each of one-shot multivibrators 31 is energized, the initiation of its quasi-stable state is precluded and energization of its output is inhibited, irrespective of the application of trigger pulses to trigger input T.

The output of tachometer 17 is connected to the input of a ring counter 32, which has a plurality of stages equal in number to one-shot multivibrators 31. Each stage of ring counter 32 is connected to trigger input T of a different one-shot multivibrator 31. Thus, during a complete engine cycle, each stage of ring counter 32 is energized in turn responsive to the pulses generated by tachometer 17 and, consequently, the quasi-stable state of each of one-shot multivibrators 31 is initiated in turn. A reset tachometer 33, which could be a magnetic type pickup pulse generator driven by the engine, is phased to produce one pulse at the beginning of each complete engine cycle immediately preceding the first pulse produced by tachometer 17. Reset tachometer 33 is connected to ring counter 32, to reset it at the beginning of each complete engine cycle. Thus, synchronization is maintained between one-shot multivibrators 31 and the engine operation on a cycle-by-cycle basis without a mechanical distributor, which would require separate tachometer connections for each cylinder.

The output of function generator 30 is connected to control input C of each of one-shot multivibrators 31. The outputs of the respective one-shot multivibrators 31 are coupled through a first input of individual OR gates 34 to individual injector drivers 35, which actuate the respective fuel injectors. The fuel injectors are each opened by their respective injector drivers 35 during the interval that the output of the corresponding one-shot multivibrator 31 is energized, i.e., during the duration of the quasi-stable state of such multivibrator. As the engine parameters indicative of the engine fuel requirement change during engine operation, sensors 10, 12, and 15 and tachometer 17 respond accordingly, which varies the duration of the quasi-stable state of the respective one-shot multivibrators 31 and the open interval of the fuel injectors, to provide the required quantity of fuel.

During deceleration of the engine, the fuel injected into the cylinders does not burn, i.e., is not utilized. At such time, the absolute pressure in the intake manifold drops to its lowest value. The output of sensor 10 is connected to one input of a comparator 40. A source of positive bias potential representative of the absolute pressure in the intake manifold during deceleration is connected to the other input of comparator 40 to set the threshold level. When the output of sensor 10 drops below the threshold level indicating engine deceleration, the output of comparator 40, which is connected to inhibit input I of each of one-shot multivibrators 31, becomes energized to prevent further actuation of the fuel injectors. During this time, ring counter 32 continues to provide trigger pulses to one-shot multivibrators 31 in the proper time sequence, so as soon as the engine stops decelerating, the fuel injectors are immediately actuated once again in synchronism with the engine cycle. The described arrangement conserves fuel, which would otherwise pass through the engine with no or only partial burning.

To facilitate engine starting, the output of a one-shot multivibrator 41 is coupled through a second input of each of OR gates 34 to each of the respective injector drivers 35. The output of sensor 12 is connected through amplifier 23 to a control input C of one-shot multivibrator 41 to vary the duration of its quasi-stable state in inverse proportion to the engine coolant temperature. The starter switch of the engine, designated 42, is coupled by a capacitor 43 to a trigger input T of one-shot multivibrator 41. When the engine is started, starter switch 42 generates a trigger pulse to initiate the quasi-stable state of one-shot multivibrator 41. A pushbutton 44, or other manually operated switch, which produces a trigger pulse each time such switch is actuated, is coupled by a capacitor 45 to the trigger input T of one-shot multivibrator 41. Thus, during engine starting, when starter switch 42 is actuated and/or each time pushbutton 44 is actuated, the quasi-stable state of one-shot multivibrators 41 is initiated for a duration inversely proportional to the engine coolant temperature. One-shot multivibrator 41 serves to override one-shot multivibrators 31 and to open all the fuel injectors simultaneously for an interval dependent upon the engine coolant temperature.

Figure 2:
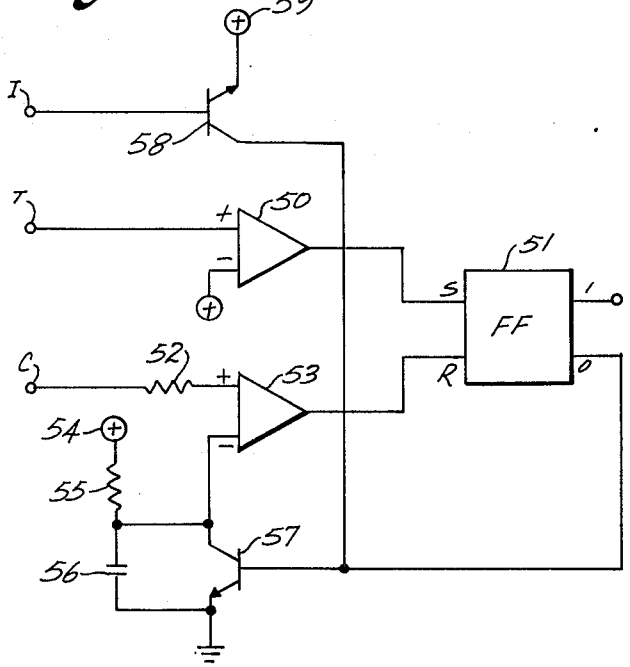
FIG. 2 is a schematic block diagram of one of the one-shot multivibrators in FIG. 1.

FIG. 2 depicts one of multivibrators 31. Trigger input T is connected to one input of a comparator 50. The other input of comparator 50 is connected to a source of positive bias potential, which sets the threshold level for the trigger pulses applied to trigger input T. The output of comparator 50 is connected to the S input of an R-S flip-flop 51. Control input C is coupled by a resistor 52 to a first input of a comparator 53. A source of positive bias potential 54 is connected by a resistor 55 to a second input of comparator 53. A capacitor 56 and the collector-to-emitter circuit of a NPN transistor 57 are connected in parallel between the second input of comparator 53 and ground. The "1" output of flip-flop 51 serves as the output of the one-shot multivibrator, which is connected to the first input of OR gate 34 (FIG. 1). The "0" output of flip-flop 51 is connected to the base of transistor 57. Inhibit input I is connected to the base of an NPN transistor 58; a source of positive bias potential 59 is connected to the emitter of transistor 58; and the collector of transistor 58 is connected to the base of transistor 57. In operation, the "0" output of flip-flop 51 is normally energized, which renders transistor 57 conductive and grounds the second input of comparator 53. When a trigger pulse is applied to trigger input T, flip-flop 51 is set, its "1" output becomes energized, and its "0" output becomes deenergized. As a result, transistor 57 becomes cut off and the voltage at the second input to comparator 53 rises as capacitor 56 charges. When the voltage at the second input of comparator 53 equals the voltage applied to control input C, the output of comparator 53 produces a trigger pulse to reset flip-flop 51, so the "0" output becomes energized once again. The one-shot multivibrator is in its quasi-stable state while the "1" output of flip-flop 51 is energized, i.e., during the interval between the setting and resetting of flip-flop 51. When inhibit input I is energized, a positive potential appears at the base of transistor 58 thereby rendering it conductive, and the second input of comparator 53 is grounded, irrespective of the state of flip-flop 51.

One-shot multivibrator 41 is as shown in FIG. 2 except for transistor 58.

Figure 4:
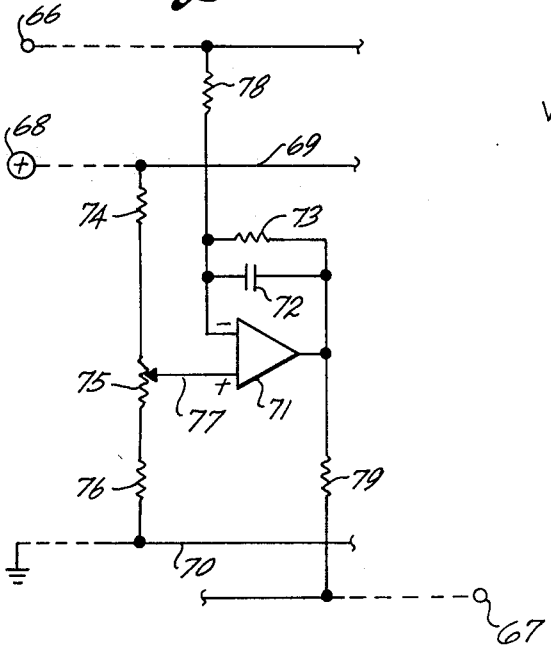
FIG. 4 is a schematic diagram of one of the stages of the function generator of FIG. 3.
Figure 3:
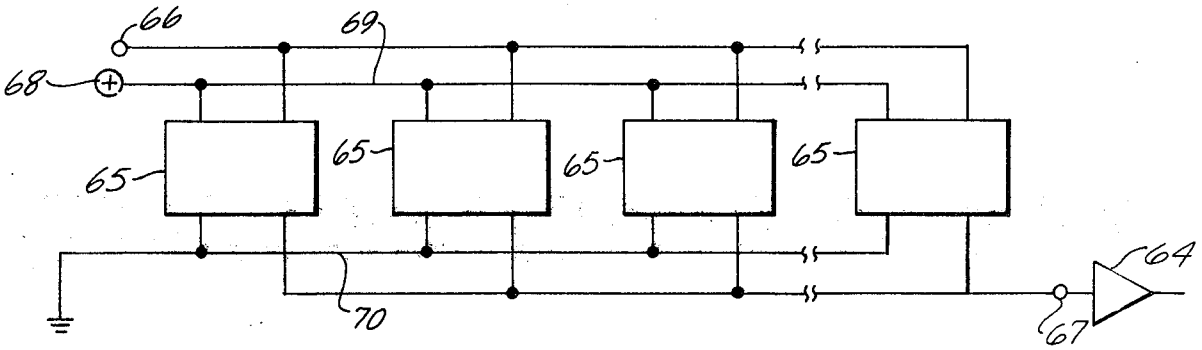
FIG. 3 is a schematic block diagram of the function generator of FIG. 1.

As depicted in FIG. 3, function generator 30 comprises a plurality of stages 65 connected in parallel between a common input terminal 66, to which summing junction 11 (FIG. 1) is coupled, and a common output terminal 67, which is coupled by an inverting amplifier 64 to each of one-shot multivibrators 31 (FIG. 1). A source of positive bias potential 68 is connected to stages 65 by a common bus 69. A common bus 70 connects stages 65 to ground. As illustrated in FIG. 4, each of stages 65 has an operational amplifier 71 with a capacitor 72 and a resistor 73 connected in parallel between its output and a first input. Capacitor 72, which has a relatively low value, is provided for the purpose of noise suppression. A resistor 74, a potentiometer 75, and a resistor 76 are connected in series in the order recited between busses 69 and 70. Potentiometer 75 has a slider arm 77 connected to a second input of operational amplifier 71. This second input is the one commonly used to apply drift correction. Common input terminal 66 is connected by a resistor 78 to the first input of operational amplifier 71. The output of operational amplifier 71 is connected by a resistor 79 to common output terminal 67. For each of stages 65, slider arm 77 is set to a different position, which applies a unique threshold voltage to the second input of the corresponding operational amplifier 71. Operational amplifiers 71 remain cut off until the voltage at their respective first inputs exceeds the respective threshold voltages, after which they amplify by different straight line factors, i.e., linearly, depending upon the value of the corresponding resistor 73.

Figure 5:
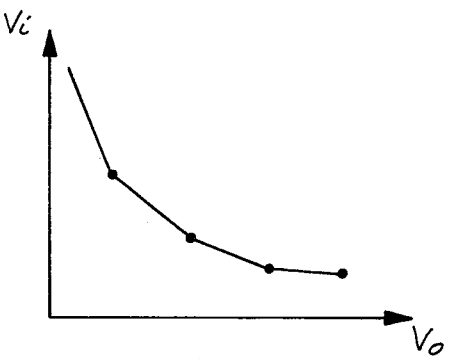
FIG. 5 is a graph depicting the transfer characteristic of the function generator of FIG. 3.

In general, the function generator is designed so its transfer characteristic comprises a plurality of interconnected straight lines having different negative slopes, which increase with $V_i$. This transfer characteristic approximates a nonlinear function that complements as nearly as possible the nonlinear functional relationship between the composite signal produced at the output of summing junction 11 and the engine fuel requirement. As a result, the signal at common output terminal 67 approximates a direct linear function of the engine fuel requirement. The number of stages 65 in the function generator depends upon the desired accuracy of the approximation of the transfer characteristic. The transfer characteristic for a function generator having four stages 65 is illustrated in FIG. 5, where the ordinate $V_i$ represents the voltage applied to common input terminal 66 and the abscissa $V_o$ represents the voltage at common output terminal 67. In operation at a very low value of $V_i$, operational amplifier 71 of each of stages 65 is cut off because the voltage applied to its first input is smaller than the threshold voltage applied to its second input. As the value of $V_i$ increases, it exceeds the threshold voltage of each of stages 65 in turn, thereby activating the corresponding operational amplifier 71 and introducing the associated slope into the transfer characteristic.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, although it is preferred to practice the various features together, in some cases one or more of them could be practiced without the remaining features.

What is claimed is:

1. A fuel injection control system for an internal combustion engine having a plurality of cylinders and an equal number of fuel injectors with a variable open interval that controls the quantity of the injected fuel, the system comprising:

first sensing means for generating a first signal with a magnitude representing one engine parameter, the magnitude of the first signal being a nonlinear function of the engine fuel requirement;

second sensing means for generating a second signal with a magnitude representing another engine parameter, the magnitude of the second signal being a nonlinear function of the engine fuel requirement;

means for additively combining the first and second signals to form a composite signal with a magnitude that is a nonlinear function of the engine fuel requirement;

function generating means responsive to the composite signal for generating a fuel requirement signal with a magnitude that is a linear function of the engine fuel requirement; and means for opening each fuel injector in turn for an interval proportional to the characteristic of the fuel requirement signal.

2. The control system of claim 1, in which each opening means comprises:

a one-shot multivibrator having a quasi-stable state the duration of which is proportional to the characteristic of the fuel requirement signal;

means responsive to engine rotation for generating trigger pulses to initiate the quasi-stable state of the one-shot multivibrator; and an injector driver that opens the fuel injector during the interval that the one-shot multivibrator is in its quasi-stable state.

3. The control system of claim 1, in which the first sensing means comprises means for generating a first signal with a magnitude representing absolute manifold pressure.

4. The control system of claim 3, in which the second sensing means comprises means for generating a second signal with a magnitude representing engine speed.

5. The control system of claim 4, additionally comprising means responsive to the second signal when the magnitude of the second signal represents operation at engine idle in gear for changing the magnitude of the composite signal by a constant amount reflecting a reduction in the engine fuel requirement.

6. The control system of claim 5, additionally comprising third sensing means for generating a third signal with a magnitude representing manifold air temperature, and means for combining the third signal with the first and second signals to form the composite signal.

7. The control system of claim 6, additionally comprising means for limiting the magnitude of the third signal at high manifold air temperature.

8. The control system of claim 7, additionally comprising fourth sensing means for generating a fourth signal with a magnitude representing engine coolant temperature, and means for combining the fourth signal with the first, second, and third signals to form the composite signal.

9. The control system of claim 8, in which the means for combining the fourth signal with the first, second, and third signals is operative only while the fourth signal is below a predetermined value indicative of a cold engine.

10. The control system of claim 1, in which the means for generating a fuel requirement signal comprises a common input, a common output, and a plurality of stages connected in parallel between the common input and the common output, each stage having an operational amplifier with a first input, a second input, and an output, means for connecting the first input to the common input, means for connecting the output to the common output, a capacitor and a resistor connected in parallel between the output and the first input, and means for connecting the second input to a source of bias voltage to cut off the operational amplifier when the signal applied to the first input is larger than the bias voltage, the impedance of the resistor and capacitor in parallel being different for the different stages and the bias voltages being different for the different stages to provide a nonlinear function that complements the nonlinear function of the magnitude of the composite signal.

11. A fuel injection control system for an internal combustion engine having a plurality of cylinders and an equal number of fuel injectors with a variable open interval that controls the quantity of the injected fuel, the system comprising:

means for sensing one or more engine parameters indicative of the engine fuel requirement to generate a fuel requirement signal with a characteristic that is a linear function of the engine fuel requirement;

a plurality of one-shot multivibrators corresponding to the respective fuel injectors, each multivibrator having a quasi-stable state initiated by a trigger pulse;

means responsive to the sensing means for controlling the duration of the quasi-stable state of the multivibrators in proportion to the characteristic of the fuel requirement signal;

means responsive to engine rotation for generating trigger pulses to initiate the quasi-stable state of each multivibrator in turn;

a plurality of injector drivers corresponding to the respective fuel injectors, each injector driver opening the corresponding fuel injector during the interval that the multivibrator corresponding to such fuel injector is in its quasi-stable state to vary the open interval of the fuel injectors to meet the engine fuel requirement;

an overriding one-shot multivibrator having a quasi-stable state initiated by a trigger pulse;

an engine starter switch generating a trigger pulse to initiate the quasi-stable state of the overriding multivibrator as the engine is started; and means for coupling the overriding multivibrator to the injector drivers to open all the fuel injectors simultaneously during the interval that the overriding multivibrator is in its quasi-stable state.

12. The control system of claim 11, in which the sensing means includes means for sensing absolute intake manifold pressure, the control system additionally comprising means responsive to the absolute pressure sensing means for inhibiting the initiation of the quasi-stable state of all the multivibrators by the trigger pulses while the absolute intake manifold pressure is below a predetermined value representative of engine deceleration.

13. The control system of claim 11, in which the sensing means includes means for sensing the temperature of the engine coolant, the system additionally comprising means responsive to the temperature sensing means for controlling the duration of the quasi-stable state of the overriding multivibrator in inverse proportion to the coolant temperature.

14. The control system of claim 13, additionally comprising a manually actuatable switch generating a trigger pulse responsive to each actuation of the switch and means for coupling the switch to the overriding multivibrator to initiate its quasi-stable state responsive to each trigger pulse generated by the switch.

15. The control system of claim 11, additionally comprising a manually actuatable switch generating a trigger pulse responsive to each actuation of the switch and means for coupling the switch to the overriding multivibrator to initiate its quasi-stable state responsive to each trigger pulse generated by the switch.

16. The control system of claim 11, additionally comprising a manually actuatable switch generating a trigger pulse responsive to each actuation of the manually actuatable switch, and means for coupling the manually actuatable switch to the overriding multivibrator to initiate its quasi-stable state responsive to each trigger pusle generated by the manually actuatable switch.

17. A fuel injection control system for an internal combustion engine having a plurality of cylinders and an equal number of fuel injectors with a variable open interval that controls the quantity of the injected fuel, the system comprising:

means for generating a fuel requirement signal with a characteristic that is a function of the engine fuel requirement;

first means for opening each fuel injector in turn for an interval proportional to the characteristic of the fuel requirement signal;

an engine starter switch;

second means responsive to the engine starter switch for opening all the fuel injectors simultaneously;

means for sensing an atmospheric condition indicative of the fuel requirement during engine starting; and means responsive to the sensing means for controlling the duration of the second opening means as the atmospheric condition changes.

18. The control system of claim 17, in which the sensing means comprises means for sensing the temperature of the engine coolant, the means for controlling the duration of the second opening means controlling such duration in inverse relation to the coolant temperature.

19. The control system of claim 18, additionally comprising a manually actuatable switch, the second means for opening all the fuel injectors simultaneously being responsive to each actuation of the switch to open all the fuel injectors simultaneously.

* * * * *